United States Patent [19]

Schmid

[11] 3,931,848

[45] Jan. 13, 1976

[54] METHOD AND APPARATUS FOR COOLING A STRAND CAST IN AN OSCILLATING MOLD DURING CONTINUOUS CASTING OF METALS, ESPECIALLY STEEL

[75] Inventor: Markus Schmid, Zurich, Switzerland

[73] Assignee: Concast AG, Zurich, Switzerland

[22] Filed: May 28, 1974

[21] Appl. No.: 474,009

[30] Foreign Application Priority Data

June 4, 1973 Switzerland ..... 8009/73

[52] U.S. Cl. ..... 164/83; 164/89; 164/283 R

[51] Int. Cl.[2] ..... B22D 11/04; B22D 11/124

[58] Field of Search ..... 164/83, 89, 283 R, 283 M, 164/283 S

[56] References Cited

UNITED STATES PATENTS

| | | | |
|---|---|---|---|
| 2,304,258 | 12/1942 | Junghaus | 164/89 |
| 2,698,467 | 1/1955 | Tarquinnee et al. | 164/89 |
| 2,947,075 | 8/1960 | Schneckenburger et al. | 164/83 UX |
| 3,129,474 | 4/1964 | Olsson | 164/83 |
| 3,753,459 | 8/1973 | Burkhardt et al. | 164/89 |
| 3,766,963 | 10/1973 | Rossi | 164/89 |

FOREIGN PATENTS OR APPLICATIONS

| | | | |
|---|---|---|---|
| 1,056,274 | 10/1953 | France | 164/82 |

*Primary Examiner*—Ronald J. Shore
*Attorney, Agent, or Firm*—Werner W. Kleeman

[57] ABSTRACT

A method of cooling a strand cast in an oscillating mold during continuous casting, wherein the strand during passage through the mold is indirectly cooled in a first zone and guided at all sides and in a final or terminal zone is guided by substantially strip-shaped support surfaces extending essentially in the direction of travel of the strand as well as directly cooled by water guided in a substantially strip-shaped configuration along the strand. The strand, following such indirect cooling and prior to the strip-shaped direct cooling, is directly cooled in an intermediate zone by the application of sprayed water.

The mold arrangement used for the performance of the method comprises a first cooling device composed of cooled walls bounding the mold compartment or cavity and a terminal cooling device composed of strip-shaped arranged support surfaces disposed approximately parallel to the lengthwise axis of the strand and strip-shaped cooling water channels located between the support surfaces. The cooling water channels are equipped with water infeed means. Between the first and the terminal cooling devices there are arranged spray nozzles constituting an additional cooling device, the spray pattern of such spray nozzles impinging the hollow mold compartment which is open at all sides between the first cooling device and the last or terminal cooling device.

17 Claims, 4 Drawing Figures

METHOD AND APPARATUS FOR COOLING A STRAND CAST IN AN OSCILLATING MOLD DURING CONTINUOUS CASTING OF METALS, ESPECIALLY STEEL

BACKGROUND OF THE INVENTION

The present invention relates to a new and improved method of cooling a cast strand which is forming in an oscillating mold during the continuous casting of metals, typically steel, wherein the strand, during its passage through the mold, is indirectly cooled in a first zone as well as guided at all sides, and in a last zone the cast strand is guided by substantially strip-shaped support surfaces extending essentially in the direction of travel of the strand as well as directly cooled by water guided in a substantially strip-like configuration along the strand. The invention further pertains to an improved construction of continuous casting mold or mold arrangement for the performance of the aforesaid method.

During the continuous casting of steel, especially at high casting speeds, it is extremely important that there be produced as uniform and as thick as possible strand shell or skin upon departure of the cast strand or casting out of the mold.

Due to the contraction of the strand shell within the mold such lifts off of the mold walls or, depending upon the cross-section of the strand and the taper of the hollow mold compartment, produces an irregular contact of the strand with the walls of the mold viewed over the periphery of the strand. Due to this irregular contact of the strand with the mold walls there is formed, especially at the lower portion of the mold, a strand shell which is of varying thickness at the outlet end of the mold and possesses the well known drawbacks, such as for instance diamond profile, fissures, metal breakouts and so forth.

Hence, for the purpose of producing strands having a uniform thickness of the shell over the periphery of the strand at the outlet end of the mold it therefore was beneficial to use short molds equipped with a subsequently arranged spray cooling device. However, the thickness of the strand shell at such mold is thin at the time that the strand departs from the mold and thus severely prone to the metal breakout phenomena, so that even the slightest defects at the strand shell can precipitate metal breakout. Hence, from the standpoint of counteracting metal breakout long molds are preferred. Yet such long molds possess at the lower region thereof an extremely small cooling capacity or efficiency, and considered with regard to the periphery of the mold, an irregular cooling efficiency. Thus, such molds are not suitable for producing uniformly thick strand shells and equally not suitable for high-speed casting operations where there should prevail safeguards against metal breakout, especially when casting billet- and bloom-cross-sections.

There is further known to the art an oscillating mold which, viewed in the direction of travel of the strand, is equipped with two different successively arranged cooling devices i.e., cooling devices working according to different cooling techniques. The first cooling device consists of cooled walls which delimit the hollow mold compartment or mold cavity. These mold walls guide the strand and indirectly cool the same. Directly following such first cooling device is the second cooling device which guides the strand by means of strip-shaped guide surfaces arranged in the direction of strand travel and the strand is directly cooled by means of strip-shaped cooling water channels located between these guide surfaces. However, this prior art mold construction is associated with the drawback that the vapor which forms in the strip-shaped cooling water can ascend at the shrinkage gap between the mold walls and the strand at the indirectly cooled mold portion up to the level of the molten bath and thus can cause explosions.

Furthermore, there is also known to the art a mold equipped with an indirect cooling arrangement and a strip-shaped direct cooling arrangement which is located after the indirect cooling arrangement in the direction of strand travel. Strip-shaped guide surfaces are provided between cooling water channels. The lower portion of the mold, which is equipped with the direct cooling arrangement, consists of two oppositely situated pivotable cooling jaws, whereas both of the other sides form an extension of the indirect cooling arrangement. At a location above the cooling water channels both of the pivotable cooling jaws are equipped with two grooves which extend transversely with respect to the direction of travel of the strand, whereby, viewed in the direction of strand travel, the first groove serves to draw-off the water vapor and the second groove, which is in communication with the cooling water channels, serves for the introduction of air. Viewed over the periphery of the mold, this mold produces an irregular shell thickness at the strand because the cooling effect at walls which abut one another is markedly different. Furthermore, the pressed-in or introduced air causes pronounced scaling of the strand surface and all grooves extending transversely with respect to the direction of strand travel tend to rapidly clog with scale. The removal of water vapor by means of the thus provided grooves is no longer insured for and the water vapor ascends to the level of the bath and can cause explosions. With such molds it is therefore not possible to fulfill those requirements which prevail for continuous casting of steel at high casting speeds.

SUMMARY OF THE INVENTION

Hence, it is a primary object of the present invention to provide an improved method of, and apparatus for, cooling a strand within an oscillating mold of a continuous casting plant during continuous casting in a manner not associated with the aforementioned drawbacks and limitations of the prior art proposals.

Another and more specific object of the present invention aims at the provision of a novel cooling technique and mold for the performance thereof, which at the lower region of such mold permits of a high and adjustable cooling output or efficiency, in order to be able to produce cast steel strands at high casting speeds with reduced risk of metal breakout and with good geometry of the cast strand.

Another object of the invention aims at an improved method of cooling a continuously cast strand in a manner preventing the danger of explosions through the rise of water or vapor to the region of the molten bath level within the casting mold.

Now in order to implement these and still further objects of the invention, which will become more readily apparent as the description proceeds, the method aspects of this development contemplate that the strand, following the indirect cooling and prior to the substantially strip-shaped direct cooling, is directly cooled in an intermediate zone by sprayed water.

When using this technique it is possible to intensively cool the strand at the lower region of the mold and the accommodate the cooling to the required conditions, without the danger existing that explosions can occur due to vapor rising in the gap between the mold and the strand and penetrating into the region of the molten bath level within the mold. By direct cooling at the second and third zones there can be attained a sufficient shell thickness at the outlet of the mold, permitting greater casting speeds. The well known high percentage of metal breakouts occurring with smaller strand formats can be considerably prevented and there can be fabricated strands, especially billet- and bloom-formats, possessing good geometry of the strand.

Not only is the invention concerned with the aforementioned method aspects but also deals with an improved construction of mold for the performance of the method, said mold being manifested by the features that spray nozzles serving as additional cooling means are arranged between the first cooling device and the last cooling device, the spray patterns of the spray nozzles impinging the hollow mold compartment which is open at all sides between the first cooling device and the last cooling device.

The proportion of metal breakouts can be further reduced according to an additional aspect of the invention if the strand, following the spray cooling thereof and prior to the strip-shaped direct cooling thereof, is supported essentially at its entire periphery and additionally indirectly cooled. This enables attaining optimum conditions for repairing incipient breakouts.

During passage of the strand through the zones equipped with direct cooling oxide layers form at the surface of the strand. In order to obtain in the successively arranged cooling zones a uniform cooling which is not affected by scale and in order to simultaneously prevent wear of the subsequent zone due to scale, a further facet of the invention contemplates scraping away and removing scale and/or slag adhering to the strand, especially the flux powder slag, following the intermediate zone and prior to entry of the strand into the next following cooling section. This can be advantageously realized in that following the devices working with direct cooling there are provided support elements equipped with scraping or stripping edges and arranged transversely with respect to the direction of travel of the strand.

The scraped- or stripped-off scale or otherwise, according to a still further aspect of the invention, is removed by the spray water without any additional expenditure being required, if the scraping edges are equipped with surfaces which slopingly descend away from the strand. In this way there also can be avoided that scale or other undesirable materials deposit at the intermediate zone.

In order that the strand passing through the last or terminal zone is uniformly cooled, it is advantageous if its surface is successively guided at least once alternately in strip-like manner and cooled by the strip-shaped guided water.

According to a further feature of the invention the mold can be constructed such that the last or terminal cooling device thereof comprises at least two successive sections equipped with strip-shaped support surfaces and the cooling water channels in the next following section are offset with respect to those in the first or preceding section and between these sections the cooling water channels are provided with cooling water exit or discharge openings which open into the surroundings.

The dimensional accuracy of the strand with respect to its shape becoming rhomboid can be improved when dealing with billet- and bloom shapes according to a further aspect of the invention if following the arrival of the strand at the last zone the edge regions of the strand are cooled by the strip-shaped guided water. Due to the uniform direct cooling of the edge regions there is formed at the corners of the strand a desired skeleton which reinforces the strand shell and renders more difficult the formation of a rhomboid shape of the strand. In order to intensify such reinforcement it is additionally advantageous to arrange the spray nozzles at the extension of the diagonals of the strand cross-section. According to a still further aspect of the invention the reinforcement can be even further considerably intensified if the strand is additionally cooled by spray cooling at the edge regions in an extended intermediate zone.

The length of the intermediate zone which is open at all sides is determined as a function of the size or format of the strand to be cast, the quality of the steel and the casting speed. In order to provide optimum conditions it is recommended to select the mold hollow compartment open at all sides, as measured in the direction of travel of the strand, to be in the order of between 4 to 20 millimeters.

In order to be able to produce an effective and uniform cooling and to maintain the pressure of the cooling water or coolant acting upon the strand shell at a low or reduced value, still a further constructional manifestation of the invention contemplates arranging the infeed means to the cooling water channels at the end thereof.

If a metal breakout is repaired in the last cooling device equipped with substantially strip-shaped arranged support surfaces and strip-shaped cooling water channels, then the strand surface, as a general rule, possesses protruding irregularities. To insure that such irregularities of the strand surface, during passage of the strand through the last zone, do not bind or become sheared off, a further aspect of the invention contemplates diverging the width, or however both the width and depth, of the cooling water channels in the last cooling device, as viewed in the direction of travel of the strand. The taper or cone diverging in the width of the cooling water channels must at least be accommodated to the shrinkage of the strand shell transversely to the direction of strand travel. As a general rule, the taper is additionally somewhat enlarged for facilitating withdrawal of the strand. In the case of molds with arc-shaped or curved mold cavities or compartments it is additionally of advantage if the plates associated with both linear sides of the strand, of the last cooling device are equipped with cooling water channels which diverge in accordance with the circular arc of the mold. By virtue of these measures there can be positively prevented renewed rupture of the strand shell at the region of the repaired breakout locations, because each irregularity which forms in this zone in the event of a disturbance can be positively withdrawn.

The shrinkage of the strand is influenced as a function of the cooling efficiency prevailing at the different successively arranged cooling zones. In order to obtain optimum supporting conditions, it is advantageous if the last cooling device is equipped with a casting taper which differs from the first casting taper.

The cooling efficiency or capacity of the water introduced into the strip-shaped cooling water channels can be increased if, according to an advantageous constructional embodiment of the invention, the strip-shaped cooling water channels are equipped with baffles.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
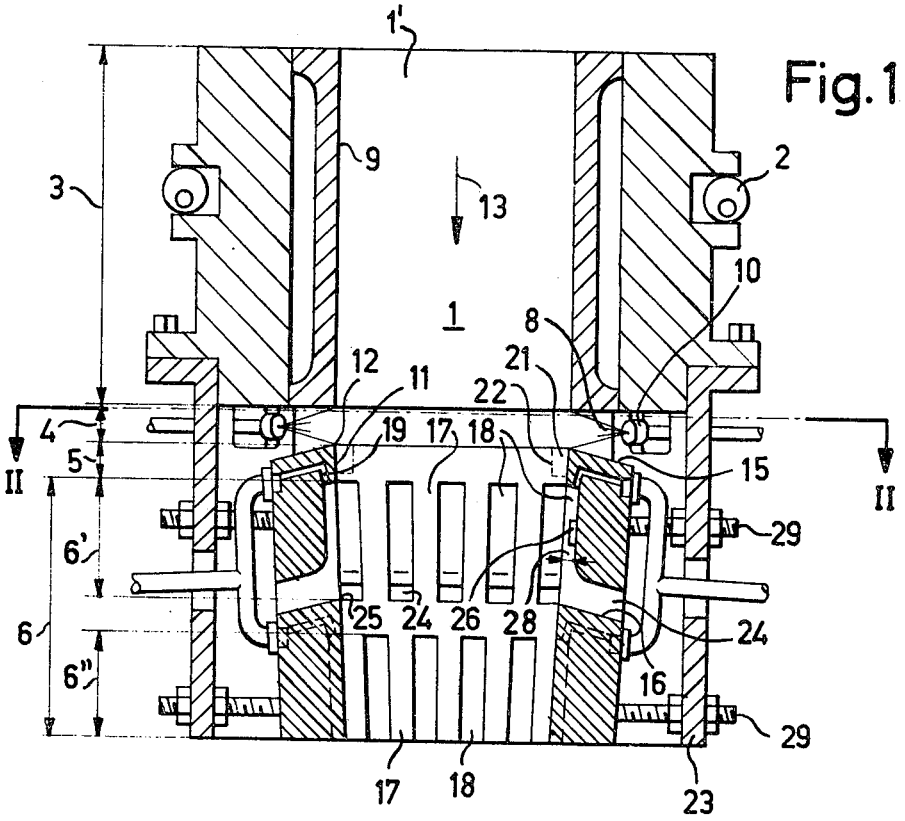
FIG. 1 is a vertical sectional view through a continuous casting mold designed according to the invention and used for carrying out the method aspects.

Describing now the drawings, it is to be understood that only enough of the continuous casting installation has been depicted in the drawings in order to simplify the illustration thereof and still sufficient to enable those versed in the art to fully understand and appreciate the underlying concepts of the invention. Hence, in FIG. 1 reference numeral 1 designates a vertically arranged continuous casting mold having a straight or linear mold cavity or hollow mold compartment 1' for casting, for instance, square or quadratic billets or blooms. By means of any suitable and therefore simply schematically illustrated oscillating drive 2 the continuous casting mold 1 is oscillated in conventional manner. The mold 1 is a multiple-part mold and consists of successively arranged cooling devices 3, 4, 5 and 6, each cooling device defining a predetermined cooling zone. The cooling device 3, viewed in the direction of strand travel, defines a first cooling zone and consists of water-cooled copper walls 9 limiting the hollow mold cavity or compartment 1'. These walls 9 are advantageously conical i.e. tapered for example, so that the hollow mold compartment 1' narrows or tapers in accordance with the contraction or shrinkage of the cast strand.

The next cooling device 4 defines a relatively short cooling zone with the hollow mold compartment laterally open and direct cooling of the strand. It is equipped with spray nozzles 10, the spray patterns or spray fans 8 of which spray the strand with a suitable coolant, typically water, along the length of such open hollow mold compartment, and wherein advantageously the edge regions are more intensely sprayed.

In the cooling device 5 the throughpassing strand is supported by support element 11 and indirectly cooled. This support element 11, which extends about the hollow mold compartment 1' transversely to the direction of strand travel, as conveniently indicated by reference character 13, is equipped with scraping or stripping edges 12. The surface 15 of each stripping edge 12 and which surface confronts the spray pattern 8 is inclined downwardly away from the strand, as shown.

The cooling device 6, as viewed in the direction of strand travel 13, constitutes the last or terminal cooling device of this multipart mold or mold arrangement 1. It consists of substantially strip-shaped arranged support surfaces 17 which extend approximately parallel to the lengthwise axis of the cast strand and intermediately arranged substantially strip-shaped cooling water channels 18 of approximately rectangular cross-section. These cooling water channels 18 are bounded by guide walls extending in the direction of strand travel and are provided with water infeed means 19. In the illustrated exemplary embodiment the cooling device 6 consists of two successively following sections 6', 6''. The strip-shaped support surfaces 17 and the cooling water channels 18 of the section 6'' are shown to be offset with respect to the same components of the preceding section 6'. Between the sections 6', 6'', the cooling water channels 18 are equipped with exit or outlets openings 24 for the water vapor mixture, and which exit openings 24 open into the surroundings. Stripping edges 25 and surface 16 which are downwardly sloped or inclined away from the strand insure for the stripping and removal of the water and scale from the strand. After the cooling section 6'' the cooling water leaves the cooling water channels 18 in the direction of strand travel 13.

By mounting baffle plates or baffles 26 at the cooling water channels 18 the turbulence of the cooling water and thus the cooling output or efficiency can be increased at the cooling device 6. The cooling efficiency or capacity of the cooling device 6 is, however, also capable of being regulated by the depth 28 of the cooling water channels 18, so that with decreasing depth 28 the cooling efficiency becomes greater. As a general rule such channels are fabricated so as to possess up to about 4 millimeters depth. The infeed means 19 for the cooling water into such channels are advantageously arranged at the end thereof in such a way that the cooling water flows along the strand in its direction of travel 13. It is however also possible to introduce the cooling water into the channels 18 transversly or in a direction opposite to the direction of strand travel 13.

The hollow mold compartment open at all sides and following the first cooling device 3, measured in the direction of travel 13 of the strand, preferably is in the order of 4 to 20 millimeters. It can be desirable to additionally cool the strand at the edge regions by spray cooling at an extended intermediate zone. For this purpose it is necessary to provide openings 21 at the support elements 11 of the cooling device 5 at the region of the mold edges, as indicated by the phantom or broken lines 22. The edges of the openings 21 thus assume the function of the scraping or stripping edges. These openings 21 however also can extend along the section 6'. The nozzles 10 are adjusted such that the strand edges are intensively cooled. Additional nozzles can be arranged in or at the openings 21 for cooling such edges.

The cooling device 6 is connected through the agency of a support or carrier frame 23 with the cooling device 3. It is possible to adjust the casting taper of the cooling device 6 independently of the casting taper of the cooling device 3 by means of an adjustment mechanism, for instance screws 29 or any other similar or equivalent adjustment means. In order to be able to improve guiding of the strand at the cooling device 6 and to reduce the likelihood of wear of the cooling device 6 by virtue of the action of the strand, a not particularly illustrated rim of rollers is advantageously provided at the discharge end of such cooling device.

Figure 2:
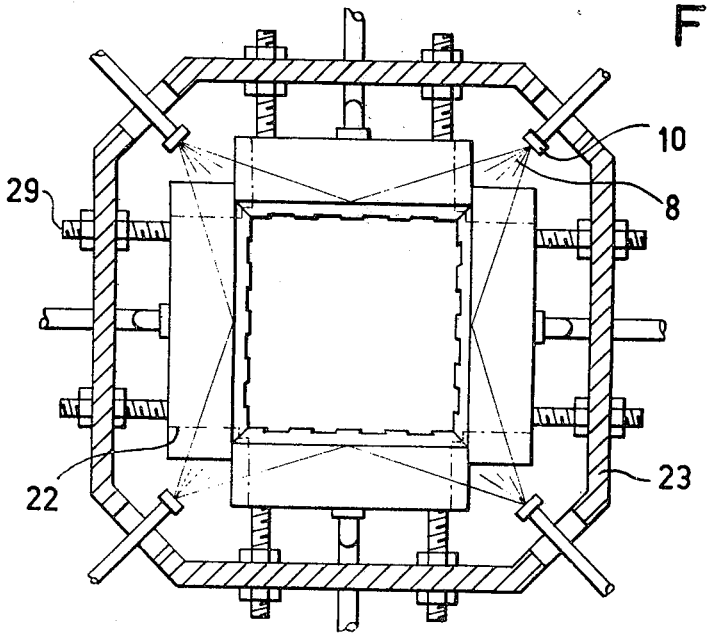
FIG. 2 is a cross-sectional view of the mold arrangement depicted in FIG. 1, taken substantially along the line II—II thereof.

In FIG. 2 there are visible the spray nozzles 10 which are arranged at the extension of the diagonals of the strand cross-section. Other arrangements of the spray nozzles 10 are of course possible.

The total length of the decribed multiple-part mold, for instance in the case of a billet cross-section of 120 × 120 $mm^2$ and for a casting speed of 4 meters per minute amounts to, for instance, 950 millimeters.

The functioning of the cooling technique effective at the strand which is being formed in the continuous casting mold is as follows: In the first cooling zone 3 there begins to form a strand shell or skin. This cooling zone 3 corresponds to the known molds. Due to contraction of the cast strand the strand shell lifts off of the mold walls at the lower region of this cooling zone 3 and, as is well known, there is no longer insured for a uniform cooling of the strand over the periphery of such strand. This irregular strand cooling phenomena produces irregular thickness of the strand shell, especially at the edge regions, resulting in distortion of the shape of the strand from the desired shape, namely producing a diamond-like or rhombic strand section configuration. In order to correct as early as possible the effect of such irregular cooling, the strand is uniformly cooled in an intermediate zone over its entire periphery or with a suitable predetermined cooling intensity, by means of the spray nozzles 10, this intermediate zone being defined by the cooling device 4. The length of this intermediate zone, measured in the direction of strand travel 13, as a general rule is chosen such that the time required for passage of the strand through this open intermediate zone amounts to less than one second. In the case of billet sections or shapes, in the order of, for instance, 120 × 120 $mm^2$, and with a casting speed of 4 meters per minute, the throughpassage time amounts to 0.18 seconds for a height of the intermediate zone amounting to 12 millimeters. In such short time intervals any possibly starting metal breakouts do not have sufficient time to develop into nonrepairable breakouts. On the other hand, due to the intensive spray cooling action heat is intentionally withdrawn from the strand during this short time. Notwithstanding the intensive cooling action vapor pressure cannot form in this open zone and thus there is eliminated the rise of vapor into the first zone. Furthermore, any vapor-water mixture which possibly ascends from the cooling device 6 escapes out of the open zone, so that it cannot ascend in the first zone.

Prior to entry into the next following zone i.e. for instance cooling device 5, the scale and slag are removed from the strand surface due to the action of the stripping or scraping edges 12 and the cooling water. During casting with flux powder slag it is particularly advantageous to remove such from the mold prior to the next following cooling process. The inclined surfaces 15 insure for a faultless flowing away of the nonmetallic substances removed from the strand together with the cooling water. Wear of the intermediate zone due to accumulation of scale and/or slag is thus rendered impossible. In the subsequent cooling device 5 the strand shell is preferably cooled by indirect cooling.

In the last or terminal zone i.e., in the cooling device 6, the length of which can amount to for instance 30 to 50% of the first zone, there is supported about 50 to 70% of the surface of the still thin strand shell. The unsupported strand surface is intensively cooled by an adjustable quantity of water. Due to the high flow velocity of the cooling water in the open cooling channels there is practically completely prevented a rise in pressure within the channels and in the case of a possibly damaged strand shell there is thus rendered impossible penetration of vapor and water into the strand. During passage of the strand through the last or terminal zone its surface can be successively and alternately guided at least once by the strip-like guide surfaces and cooled by the strip-shaped guided flowing water. In order to be able to directly cool the edge regions of the strand early enough also at the last zone, following entry of the strand into this zone, the edge regions of the strand are cooled in the first section 6' by substantially strip-shaped guided water.

Figure 3:
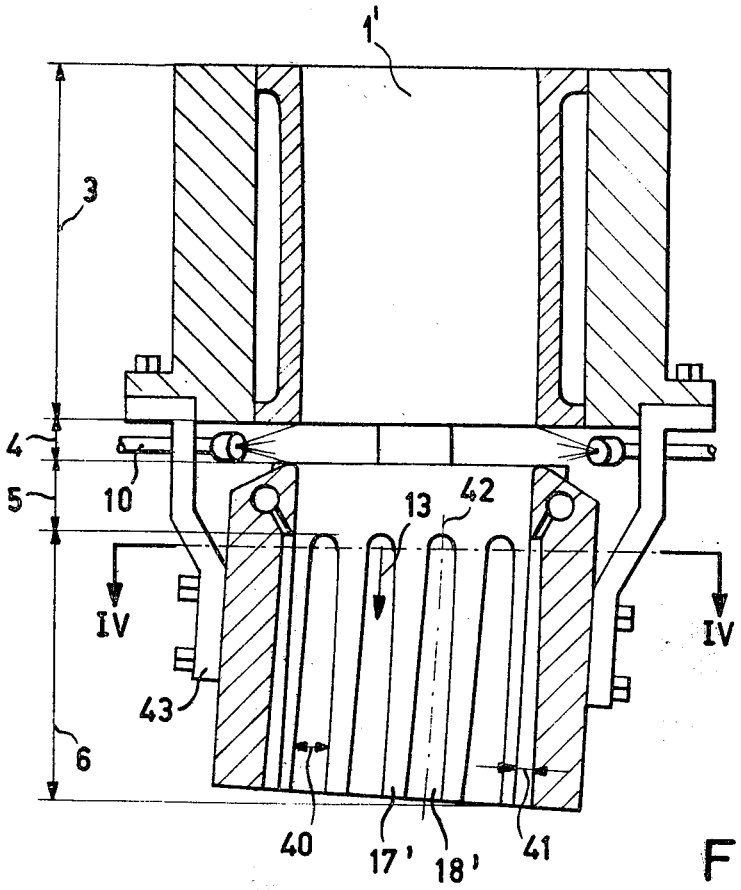
FIG. 3 is a vertical sectional view through another exemplary embodiment of the invention.
Figure 4:
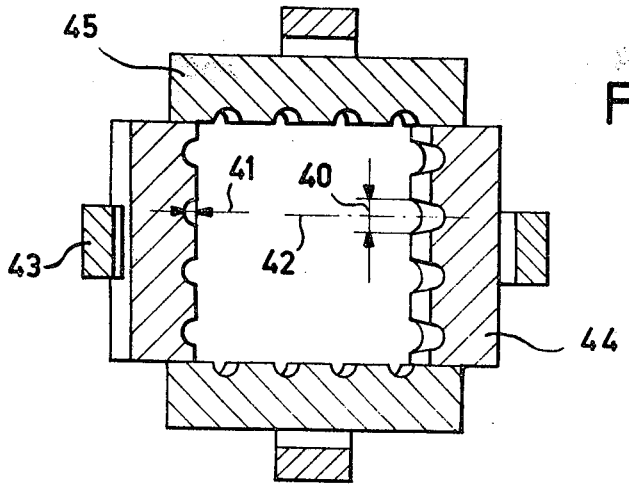
FIG. 4 is a cross-sectional view of the arrangement depicted in FIG. 3, taken substantially along the line IV—IV thereof.

FIGS. 3 and 4 illustrate in a simplified showing a multiple-part arcuate or curved mold. The cooling device 6 consists of substantially strip-shaped support and guide surfaces 17' arranged approximately parallel to the lengthwise axis of the strand and intermediately disposed cooling water channels 18' which have a rounded cross-section. These cooling water channels 18'to diverge in the direction of strand travel 13, both in their width 40 as well as also in their depth 41. The cooling water channels 18' which conically widen or divergingly taper in the direction of travel 13 of the strand are preferably symmetrical with respect to their central axes 42 which extend essentially parallel to the direction of strand travel 13. The cone or taper amounts to about 1%. When equipping the last cooling device 6 with such diverging cooling water channels 18' it is possible to repair breakouts which begin at the cooling device 5 or the cooling device 6, and to remove the cast strand from the mold without damaging the strand skin or shell. Reference numeral 43 designates, in simplified illustration, connecting elements between the cooling device 3 and the cooling devices 5 and 6. Oppositely situated plates 44 and oppositely situated plates 45 are associated with the curved and straight sides of the strand respectively. The limiting or boundary surfaces of the cooling water channels 18' in the depth 41 in the plates 44 and the limiting or boundary surfaces of the channels 18' in which the width 40 in the plates 45 can be accommodated to the mold radius.

The width 40 of such cooling water channels 18' and the width of the support surfaces 17' are selected to be in the order of between 5 to 50 millimeters, depending upon the strand section or format. In the case of a billet shape having the dimensions 100 × 100 $mm^2$ cooling water channels 18 of 10 millimeters width and support surfaces 17 of 10 millimeters width have been found to be particularly useful.

The principles of the invention as concerns both the method aspects and the exemplary embodiments of apparatus, given herein purely by way of example and not limitation, also can be employed in conjunction with molds for casting round-, polygonal- or slab- sections or fomats.

While there is shown and described present preferred embodiments of the invention it is to be distinctly understood that the invention is not limited thereto, but may be otherwise variously embodied and practiced within the scope of the following claims. Accordingly,

What is claimed is:

1. A method of cooling a strand in an oscillating continuous casting mold during the continuous casting of metals, especially steel, comprising the steps of:

a. forming a cast strand in the continuous casting mold and which strand travels through the mold;

b. indirectly cooling the cast strand as well as guiding the cast strand at all sides in a first zone during passage of the strand through the mold;

c. after the indirect cooling of the strand of step (b) spraying water onto the cast strand to directly cool the cast strand in an intermediate zone which is open at all sides; and d. in a last cooling zone guiding the strand by means of substantially strip-shaped support surfaces extending essentially in the direction of travel of the strand and between these support surfaces directly cooling the strand by water guided in substantially strip-shaped water channels in a substantially strip-shaped configuration along the strand.

2. The method as defined in claim 1, including the step of supporting the cast strand essentially at its entire periphery and additionally indirectly cooling the cast strand after the spray cooling of step (c) and prior to subjecting the strand to the strip-shaped direct cooling of step (d).

3. The method as defined in claim 1, including the step of stripping away at least part of any scale and slag adhering to the surface of the strand following passage of the strand through the intermediate zone and prior to entry of the strand into a next following zone.

4. The method as defined in claim 1, further including the step of alternately subjecting the strand at least once in succession as it passes through the last cooling zone to a strip-shaped guiding of the strand and a cooling of such strand by means of strip-shaped guided water.

5. The method as defined in claim 1, further including the step of cooling the edge regions of the cast strand by means of a prolonged spray cooling action in a cooling zone which immediately follows the intermediate zone.

6. A mold arrangement for continuous casting of metals, comprising a mold, means for oscillating said mold, said mold being composed of a first cooling device formed of cooled walls bounding a hollow mold compartment of the mold through which travels a cast strand in a predetermined direction of travel, a last cooling device formed of substantially strip-shaped arranged support surfaces disposed approximately parallel to the lengthwise axis of the cast strand and equipped with intermediately situated strip-shaped cooling water channels, water infeed means provided for said cooling water channels, and an additional cooling device equipped with spray nozzles arranged between the first cooling device and the last cooling device, said hollow mold compartment being open at all sides at a location between the first cooling device and the last cooling device, said spray nozzles producing a spray pattern which impinges the hollow mold compartment which is open at all sides between the first cooling device and the last cooling device.

7. The mold arrangement as defined in claim 6, further including support elements arranged after the additional cooling device transversely with respect to the direction of travel of the strand, said support elements being equipped with stripping edges.

8. The mold arrangement as defined in claim 7, wherein said stripping edges are equipped with surfaces means which downwardly slope at an inclination away from the cast strand.

9. The mold arrangement as defined in claim 6, wherein the length of the portion of the hollow mold compartment which is open at all sides is in the order of between 4 to 20 millimeters viewed in the direction of travel of the strand.

10. The mold arrangement as defined in claim 6, wherein the last cooling device comprises at least two successively arranged sections each equipped with substantially strip-shaped support surfaces and substantially strip-shaped cooling channels, wherein the cooling water channels of one section are offset with respect to the cooling water channels of a preceding section and between said sections the cooling water channels are equipped with cooling water outlet openings which open into the surroundings.

11. The mold arrangement as defined in claim 6, wherein the water infeed means are arranged at an end of each of the channels.

12. The mold arrangement as defined in claim 6, wherein the cooling water channels are bounded by guide walls extending in the direction of travel of the strand and diverge in width in the direction of travel of the strand.

13. The mold arrangement as defined in claim 12, wherein the cooling water channels diverge in depth in the direction of travel of the strand.

14. The mold arrangement as defined in claim 12, wherein said mold defines an arcuate mold having a curved hollow mold compartment, and the last cooling device is equipped with plate members associated with both straight sides of the strand and said plate members having diverging cooling water channels which diverge in accordance with the arc of the mold.

15. The mold arrangement as defined in claim 6, wherein the last cooling device is provided with a casting taper which differs from the casting taper of the first cooling device.

16. The mold arrangement as defined in claim 6, wherein the substantially strip-shaped cooling water channels are equipped with baffle means.

17. A mold arrangement for continuous strand casting of metals, comprising a curved mold composed of a first cooling device formed of cooled walls bounding a curved hollow mold compartment of the mold, a last cooling device formed of substantially strip-shaped arranged support surfaces disposed approximately parallel to the lengthwise axis of the cast strand and equipped with intermediately situated substantially strip-shaped cooling water channels, water infeed means provided for said cooling water channels, an additional cooling device equipped with spray nozzles arranged between the first cooling device and the last cooling device, said spray nozzles producing a spray pattern which impinges the hollow mold compartment which is open at all sides at a location intermediate the first cooling device and the last cooling device, the last cooling device being equipped with plate members associated with both straight sides of the strand, said plate members having cooling water channels which follow the curved arc of the mold and which diverge in the direction of strand movement.

* * * * *